US011668216B2

(12) United States Patent
Fischer et al.

(10) Patent No.: US 11,668,216 B2
(45) Date of Patent: Jun. 6, 2023

(54) METHOD FOR PROVIDING A POWER SUPPLY FOR AT LEAST ONE ELECTRICALLY HEATABLE CATALYST OF A MOTOR VEHICLE SITUATED IN AN EXHAUST GAS TRACT, AND A MOTOR VEHICLE COMPRISING AT LEAST ONE ELECTRICALLY HEATABLE CATALYST SITUATED IN AN EXHAUST GAS TRACT OF THE MOTOR VEHICLE

(71) Applicant: AUDI AG, Ingolstadt (DE)

(72) Inventors: Markus Fischer, Neuburg (DE); Christian Glück, Ingolstadt (DE); Thomas Hackner, Greding (DE); Viktor Kell, Neustadt (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 17/671,181

(22) Filed: Feb. 14, 2022

(65) Prior Publication Data

US 2022/0259996 A1 Aug. 18, 2022

(30) Foreign Application Priority Data

Feb. 15, 2021 (DE) ..... 102021103481.7

(51) Int. Cl.
*F01N 3/027* (2006.01)
*F01N 3/20* (2006.01)

(52) U.S. Cl.
CPC ..... *F01N 3/2013* (2013.01)

(58) Field of Classification Search
CPC .... F01N 3/027; F01N 3/2013; F01N 2240/16; F01N 2900/104
See application file for complete search history.

(56) References Cited

U.S. PATENT DOCUMENTS 5,488,283 A 1/1996 Dougherty et al.
2012/0255279 A1* 10/2012 Atluri ..... F01N 3/027 60/299

FOREIGN PATENT DOCUMENTS

DE 102 29 018 A1 2/2003
DE 10 2012 002 778 A1 8/2012
(Continued)

OTHER PUBLICATIONS

Machine translation of JP-H0524489-A, accessed Aug. 25, 2022. (Year: 2022).*

*Primary Examiner* — Jonathan R Matthias
(74) *Attorney, Agent, or Firm* — Seed Intellectual Property Law Group LLP

(57) ABSTRACT

A method for providing a power supply for at least one electrically heatable catalyst of a motor vehicle situated in an exhaust gas tract, wherein the motor vehicle comprises a first battery, by means of which a first voltage $U_1$ is generated, and a second battery, by way of which a second voltage $U_2$ is generated, wherein the at least one catalyst during a start phase immediately following the start of an internal combustion engine of the motor vehicle is supplied by a power $P_1$ provided by the first battery such that the voltage $U_1$ of the first battery is imposed on the at least one catalyst, wherein the at least one catalyst is additionally supplied during the start phase by a power $P_2$ provided by the second battery such that the voltage $U_2$ of the second battery is transformed by a DC converter to the value of the voltage $U_1$ which is imposed on the at least one catalyst.

6 Claims, 2 Drawing Sheets

(56) References Cited

FOREIGN PATENT DOCUMENTS

| | | | | | |
|---|---|---|---|---|---|
| DE | 10 2012 221 364 | A1 | | 5/2013 | |
| DE | 102016206108 | A1 | * | 10/2017 | |
| DE | 10 2018 120 402 | A1 | | 2/2019 | |
| GB | 2541426 | A | * | 2/2017 | ..... B60L 1/12 |
| JP | H0524489 | A | * | 2/1993 | |

* cited by examiner

METHOD FOR PROVIDING A POWER SUPPLY FOR AT LEAST ONE ELECTRICALLY HEATABLE CATALYST OF A MOTOR VEHICLE SITUATED IN AN EXHAUST GAS TRACT, AND A MOTOR VEHICLE COMPRISING AT LEAST ONE ELECTRICALLY HEATABLE CATALYST SITUATED IN AN EXHAUST GAS TRACT OF THE MOTOR VEHICLE

BACKGROUND

Technical Field

Embodiments of the present invention relate to a method for providing a power supply for at least one electrically heatable catalyst of a motor vehicle situated in an exhaust gas tract, wherein the motor vehicle comprises a first battery, by means of which a first voltage $U_1$ is generated, and a second battery, by means of which a second voltage $U_2$ is generated, wherein the at least one catalyst during a start phase immediately following the start of an internal combustion engine of the motor vehicle is supplied by means of a power $P_1$ provided by the first battery such that the voltage $U_1$ of the first battery is imposed on the at least one catalyst.

Description of the Related Art

The use of electrically heatable catalysts, hereinafter called EHCs for short, in motor vehicles is known in the prior art. Thus, it is typically required in connection with catalysts to bring a catalytically coated structure of the catalyst or the exhaust gas being cleaned up to a particular minimum temperature, or else the cleaning of the exhaust gas cannot occur efficiently. For this purpose, EHCs often comprise electrically operated heating discs or the like, which are supplied by means of a power supply voltage present in an onboard network of the motor vehicle.

An especially demanding phase in terms of the power supply of the EHC is the start phase, occurring in time immediately after the starting of an internal combustion engine of the motor vehicle, especially since mandatory limits in regard to emission of pollutants such as the exhaust gas standard EU7 need to be obeyed. Thus, it is typically required during the entire start phase to supply the EHC with its maximum power, corresponding roughly to a known operating power $P_{EHC}$ of the EHC. The start phase, especially when a gasoline engine is provided as the internal combustion engine, may last up to 30 seconds or more. The power supply of the EHC during the start phase usually occurs by means of the first battery, which may be an electrical medium or high-voltage energy accumulator. A utilization of the internal combustion engine to provide the electrical power needed on the part of the EHC or to support the first battery is not possible, since this loading would even further increase the pollution emission of the internal combustion engine.

In order to present in a clear and understandable manner the shortcomings which occur during the start phase in the prior art, we shall consider the case in the following example when the first battery is a 48V lithium battery having an overall capacity of 850 Wh and two EHCs are provided, each having an indicated rated or operating power of 5 kW, and the start phase has a duration of d=30 s. It should be noted that the following theoretical discussion, even though based on explicit numerical values for a better understanding, can be applied to embodiments of the present invention, without limiting its general nature, as long as the particular aspect does not deviate explicitly from the teaching of the embodiments of the invention. This also holds in particular for the respective notation introduced. Thus, in the present example, we have for the overall power PEC required by the two catalysts the value $$P_{EHC}=2\cdot 5\text{ kW}=10\text{ kW},$$

so that the energy $E_{EHC}$ to be provided by the first battery will be $$E_{EHC}=P_{EHC}\cdot d=10000\text{ W}\cdot\frac{30\text{ s}}{3600\text{ s/h}}=85\text{ Wh}$$

Given the fact that the maximum cumulative overall energy is $E_0$=850 Wh, the energy $E_{EHC}$ amounts to one tenth of the storage capacity of the first battery. The relationship between the voltage imposed on the EHCs and the power $P_{EHC}$ can be described by the formula $$U^2=P_{EHC}\cdot R$$

as long as the EHCs can be considered to have no ohmic consumers. R here denotes the electrical resistance of the EHCs.

One relevant aspect in the context of this discussion is the circumstance that the first battery can only be operated and can only provide power in a certain region of its state of charge (SoC), the current state of charge SoC(t) at a time t being defined as $$\text{SoC}(t)=E(t)/E_0,$$

where E(t) designates the energy stored in the first battery at time t. In the case of the present battery, let us assume for example a SoC operating region between $\text{SoC}_0$=25% and $\text{SoC}_1$=80%. In order to be able to provide the energy required for the start phase on the part of the EHCs, there must consequently be at the first battery at the beginning of the start phase a state of charge $\text{SoC}_{min}$ of at least $$SoC_{min}=SoC_0+\frac{E_{EHC}}{E_0}=25\%+\frac{85\text{ Wh}}{850\text{ Wh}}=35\%$$

To illustrate the apportionment of the overall energy $E_0$ refer to the energy balance diagram 18 shown in FIG. 1 regarding the first battery. According to this, the maximum cumulative energy $E_0$ of the first battery is divided into an unusable component Ex on account of the SoC operating region and a usable component $E_{use}$, while in the present example we have $$E_{use}=E_0\cdot(\text{SoC}_1-\text{SoC}_0)=850\text{ Wh}\cdot(80\%-25\%)\approx 470\text{ Wh},$$

so that consequently $$E_X=E_0-E_{use}=850\text{ Wh}-470\text{ Wh}=380\text{ Wh}$$

As long as it is assumed that the first battery is fully charged at the beginning of the start phase, it emerges from FIG. 1 that the usable energy $E_{use}$ is apportioned between the part $E_{EHC}$ required by the EHCs and a usable part E* remaining at the ending of the start phase, with $$E^*=E_{use}-E_{EHC}=470\text{ Wh}-85\text{ Wh}=385\text{ Wh}$$

The energy E* after the ending of the start phase is typically used for the further required power supply of the EHC. It is easily seen from these considerations that, in the case when a state of charge of $SoC_{min}$=35% is present at the beginning of the start phase, the first battery can no longer provide any usable energy at the ending of the start phase, that is, E*=0, and would first need to be recharged for this.

One aspect not yet considered thus far in the course of the just presented discussion in pure energy terms, yet extremely relevant in practice, involves the circumstance that the power $P_1$ which can be provided by the first battery at a given time is dependent on the state of charge SoC of the first battery which is present at that time. Specifically, the power $P_1$ which can be provided by the first battery is larger as its state of charge SoC is higher. A characteristic curve regarding the first battery at a temperature of −10° C. is shown in the diagram in FIG. 2. In this diagram, the abscissa pertains to the current state of charge SoC in percent and the ordinate to the corresponding power $P_1$ in kW which can be provided by means of the first battery. It follows from the dotted lines that a state of charge of $SoC_{crit}$≈50% is required in order to provide the operating power of the two EHCs, in the present instance $P_{EHC}$=10 kW. This discussion in terms of power reveals that the value $SoC_{min}$=35% assumed thus far for the minimum possible state of charge of the first battery at the beginning of the start phase, as indicated from the standpoint of energy, needs to be adjusted accordingly for practical purposes. Thus, instead, the state of charge at the beginning of the start phase must not fall below the value $SoC_{crit}$≈50%, as long as the power which can be provided by the battery should not fall below the value $P_1=P_{EHC}$=10 kW during and especially toward the end of the start phase. It follows from this, as an immediate consequence, that the maximum value for the usable energy E*, i.e., the energy accumulated in the first battery which is still usable for the EHCs after the ending of the start phase, is reduced by the amount $$E(25\%\leq SoC\leq 50\%):=E_0\cdot(SoC_{crit}-SoC_0)=850\text{ Wh}\cdot(50\%-25\%)\approx 210\text{ Wh}$$

Consequently, in terms of the power discussion, the corrected value $E^*_{corr}$ will become $$E_{corr}^*=E^*-E(25\%\leq SoC\leq 50\%)=385\text{ Wh}-210\text{ Wh}=175\text{ Wh}.$$

Summarizing, therefore, when considering the power provided after the ending of the start phase for the further operation of the EHCs in dependence on the state of charge, the energy available after the end is reduced even further, namely, from E*=385 Wh to $E^*_{corr}$=175 Wh.

It is known from the prior art how to interconnect two batteries with one EHC such that different voltages are present at the EHC, depending on the connection condition, and therefore it becomes possible to provide different powers. Thus, it is known from DE 10 2018 120 402 A1 that either a high-voltage network or a low-voltage network is used for the power supply of the EHC, depending on a current power demand of an EHC of a motor vehicle, whereby in the first instance the power or energy of a 48V battery is provided and in the second instance that of a 12V battery.

A further concept for the energizing of an EHC by means of two batteries is known from DE 10 2012 002 778 A1 and DE 10 2012 221 364 A1. In this concept, the two batteries can be hooked up in series or in parallel with each other, and a generator can be switched in for the charging of the batteries.

Back to the example presented above. In connection with the start phase it is often the case in practice that the first battery is not fully charged at the beginning of the start phase, especially after a lengthy standstill of the motor vehicle. In order to assure nonetheless the power $P_{EHC}$ required for the operation of the EHC immediately after the ending of the start phase, it is typically provided that the corresponding energy to compensate for any energy difference during the start phase is made available in a second battery, especially a 12V battery, of the motor vehicle. After the ending of the start phase, the energy kept on hand in the second battery is called upon.

If it is assumed for example that the state of charge of the first battery is SoC=25% at the ending of the start phase and that it must then be raised to SoC=50% for the further operation of the EHC by means of the second battery, it would be necessary to provide an energy $E_{Diff}$ of $$E_{Diff}=E(25\%\leq SoC\leq 50\%)=210\text{ Wh}$$

on the part of the second battery. However, this energy transfer is problematical, since it must take place as swiftly as possible, and a large component of energy will be dissipated or "lost" in this case, especially because components of the motor vehicle such as controllers and/or busbars are involved in the energy transfer. In effect, the energy to be provided by means of the second battery will be further increased on account of this loss.

BRIEF SUMMARY

Some embodiments provide an improved concept for providing the operating power of an electrically heatable catalyst of a motor vehicle as compared to the prior art, especially in regard to transfer-related energy losses.

This problem is solved, in a method of the aforementioned kind, in that the at least one catalyst is additionally supplied during the start phase by means of a power $P_2$ provided by the second battery such that the voltage $U_2$ of the second battery is transformed by means of a DC converter to the value of the voltage $U_1$ which is imposed on the at least one catalyst.

Some embodiments are based on the idea that the power of the EHC required during the start phase and immediately after the end of the start phase, especially the known rated or operating power $P_{EHC}$, is provided not only on the part of the first battery, but also in addition on the part of the second battery. In this way, there is ideally no need whatsoever for a relatively brief energy transfer to occur between the second battery and the battery or the EHC at the end of the start phase. In this way, at least the amount of energy to be transmitted in the course of this energy transfer is reduced, so that the resulting energy losses can be kept low. Any power supply gap between the ending of the start phase and the ending of the energy transfer is also reduced or entirely eliminated.

The first battery, which can be a 48V battery, is typically used to supply a first onboard network of the motor vehicle. The second battery, which can be a 12V battery, is typically used to supply a second onboard network of the motor vehicle.

The DC converter, also called a DC-DC transformer, is in particular an electrical circuit which transforms a DC voltage present at its input, in the present instance the voltage $U_2$ of the second battery, to a higher or lower voltage level, namely, the voltage value $U_1$ of the first battery. The functioning of such DC converters is sufficiently known to the person skilled in the art.

In some methods, it is provided in particular that the second battery is switched on with regard to the power supply of the EHC for example by means of a switch, which is actuated by a control mechanism provided to carry out the method. In other words, the first battery, the second battery and the at least one EHC are incorporated in an electrical circuit, comprising components based in particular on semiconductor technology, in such a way that at least two possible circuit conditions are conceivable. In a first circuit condition, the EHC is energized only by the first battery, while in a second circuit condition the EHC is additionally energized by the second battery. In the second circuit condition, the system formed from the first battery, the second battery and the DC converter may work such that two parallel switched voltage sources of identical voltage $U_1$ are present at the EHC, the one voltage source being the first battery and the other or second voltage source being formed so to speak by the second battery and the DC converter. A switching between the first and the second circuit condition has the effect that, in terms of the power supply, either only the first battery is used, or the first battery is used together with the second battery, and in both circuit conditions the voltage $U_1$ is present on the EHC.

In some methods, it may be provided that the power supply of the EHC is assured by means of both batteries either during the entire start phase or only during certain time intervals of the start phase. It is conceivable that the power demand of the at least one EHC is constant during the start phase and corresponds in particular to the value of the known rated or operating power $P_{EHC}$. Alternatively, it is conceivable that the power demand of the at least one EHC is variable during the start phase. This variability can be taken into account in the method for example by switching in the second battery during phases of an increased power demand of the at least one EHC.

In one modification of the method it may be provided that the first battery only provides the power $P_1$ in a particular region of its state of charge SoC, and this region is bounded by a lower value $SoC_0$ and an upper value $SoC_1$, wherein the lower value $SoC_0$ amounts in particular to 25% and the upper value $SoC_1$ in particular to 80% of a maximum state of charge of the first battery, and the energy $E_{EHC}$ consumed during the start phase of the at least one EHC is apportioned between the first battery and the second battery such that, upon ending of the start phase, the state of charge SoC of the first battery corresponds at least to the lower value $SoC_0$. Thus, it is provided that roughly the sum of the energy taken from the first and that from the second battery during the start phase corresponds to the energy $E_{EHC}$ required by the EHC during the start phase, and these components are apportioned such that, at the moment of the ending of the start phase, the state of charge SoC of the first battery corresponds exactly to the value at which the first battery can still provide a power to the EHC. Any energy losses can be additionally considered in this discussion. Hence, the first battery provides the power $P_1$ to the EHC not only during the start phase, but also at the moment of ending of the start process. Furthermore, consideration can be given to the fact that the second battery also may only provide the power $P_2$ in a particular region of its state of charge SoC.

The setting of the apportionment of the energy taken from the two batteries during the start phase can be done, for example, in that the duration of the start phase during which both batteries supply power to the at least one EHC is set appropriately. In this case, any variability of the power demand of the at least one EHC during the start phase may be taken into account.

Typically, the power $P_1$ which can be provided by the first battery depends on its current state of charge SoC, while the energy $E_{EHC}$ consumed during the start phase by the at least one EHC is apportioned between the first battery and the second battery such that, upon ending of the start phase, the power $P_1$ which can be provided by the first battery corresponds at least to the power of the at least one catalyst which is required at this time. In this embodiment, hence, the practically relevant circumstance is taken into account, that the power which can be provided customarily by a battery is dependent on the current state of charge, i.e., the ratio of the energy currently stored in the battery and the maximum energy which can be stored in the battery. Thus, it is ensured in this embodiment that, at the time of ending of the start phase, the power provided by means of the two batteries is sufficient to supply the EHC with its operating power required at that time. If it is ensured that the power $P_1$ provided for this by means of the first battery is accordingly sufficient, then there is basically no longer needed an energy transport from the second battery to the EHC at this time. The circumstance that the power $P_2$ which can be provided by the second battery is also dependent on its current state of charge SoC may also be taken into account.

A known characteristic curve and/or a lookup table and/or a model, especially an analytical model, may be used to apportion the energy $E_{EHC}$ consumed during the start phase by the at least one EHC between the first battery and the second battery, which describes the region of the state of charge SoC of the first battery in which it provides the power $P_1$, and/or the dependency of the power $P_1$ which can be provided by the first battery on its state of charge SoC, especially in temperature-dependent manner. The corresponding data can be stored in a control mechanism of the motor vehicle which is adapted to control the method. A metered value of a temperature sensor of the motor vehicle regarding the current temperature can be used, so that the temperature-dependent relation between the corresponding variables can be taken into account. Likewise, it can be provided that the corresponding values are established based on a minimum possible temperature of −25° C., for example.

In the context of the method it may be provided that the at least one catalyst is supplied in addition by means of the power $P_2$ provided by the second battery only during the start phase. Hence, in this embodiment, it is provided that the second battery is no longer used to supply the EHC, starting at the time of the ending of the start phase, and instead other energy supply sources are used, especially the first battery. In particular, no expense to control the second battery is needed any longer to supply the EHC with energy or power after the ending of the start phase.

Alternatively, it may be provided that the at least one catalyst is also supplied in addition by means of the power $P_2$ provided by the second battery also after the ending of the start phase. In particular, it is conceivable that both the first battery and also the second battery are used for the energy or power supply of the EHC after the ending of the start phase. This variant is especially useful when only a limited energy can be provided on the part of the second battery during the start phase. Thus, it is conceivable in this regard that the power provided by means of the second battery during the start phase is bounded at the top, since only a limited maximum power can be transferred by means of the DC converter, and this maximum power is less than the power which can basically be provided by the second battery.

In the method it may be provided that the energy $E_{EHC}$ transferred during the start phase and/or after the end of the start phase from the first battery and the second battery to the at least one catalyst is apportioned by a fixed or adjustable provision quotient Q between the first battery and the second battery. Hence, the energy required by the EHC is apportioned according to the provision quotient Q, in particular evenly, between the first battery and the second battery, so that the corresponding control system expense can also be reduced. The provision quotient Q can be defined roughly as the quotient of the energy $E_1$ transferred during the start phase from the first battery and the overall energy $E_{EHC}$ required by the at least one EHC. If this value is firmly dictated, it may in particular amount to the value ½, so that the energy $E_{EHC}$ consumed by the at least one EHC during the start phase is equally apportioned between the two batteries.

The provision quotient Q can be taken into account by setting the duration d* during which the two batteries provide power in dependence on the provision quotient Q. This shall be explained with the aid of an example where the power demand of the at least one EHC is constant and corresponds to the value $P_{EHC}$, it being further assumed for example that this power is equally apportioned between the two batteries, insofar as both batteries are used for the power supply of the at least one EHC. Given the assumption of the above given definition of the provision quotient Q, we have the relation $$Q = \frac{E_1}{E_1 + E_2} = \frac{P_{EHC} \cdot (d - d^*) + \frac{1}{2} P_{EHC} \cdot d^*}{P_{EHC} \cdot d} = 1 - \frac{d^*}{2d}$$

so that ultimately we have for the value d* to be set in dependence on the provision quotient Q and the duration d of the start phase the value $$d^* = 2d(1-Q)$$

It is seen from this that the value for the provision quotient Q in this example can only take on values between ½ and 1, the smallest possible value being Q=½ in the case when the second battery is switched in during the entire start phase (i.e., d*=d), and the largest possible value being Q=1 in the case when the second battery is not switched in at all during the start phase (i.e., d*=0). Further circumstances can also be taken into account in this computation, such as the battery powers dependent on the state of charge and/or a variable power demand on the part of the at least one EHC.

The provision quotient Q can furthermore be set in variable manner. Thus, it may either be chosen accordingly at the beginning of the start phase and adjusted in ongoing manner in addition or alternatively during the start phase. The provision quotient Q can be set, for example, with the aid of at least one state of charge information item describing the state of charge SoC of the first battery and/or the state of charge SoC of the second battery, the state of charge information being ascertained by means of at least one sensor of the motor vehicle and/or being present any way in the context of a controlling of the motor vehicle carried out by means of a control unit.

From the variability of setting the provision quotient Q we have the advantage that this can be set optimally for the specific situation. If it turns out, with the aid of the known relations between the state of charge SoC of the first battery and the power $P_1$ which it can provide, that a certain maximum value of the power $P_1$ which can be provided by means of the first battery will presumably result during the start phase, the provision quotient Q can be adjusted so that the power demand of the at least one EHC is assured at every moment of the start phase thanks to the power $P_2$ provided by the second battery. Moreover, it is conceivable that, already at the beginning of the start phase, it is predictable that a certain power demand will exist after the ending of the start phase in one of the onboard networks, and the provision quotient may be set accordingly such that the affected battery can provide the required power after the ending of the start phase.

Embodiments of the invention furthermore relate to a motor vehicle comprising at least one electrically heatable catalyst situated in an exhaust gas tract of the motor vehicle, an internal combustion engine, a first battery, by means of which a first voltage $U_1$ can be generated, and a second battery, by means of which a second voltage $U_2$ can be generated, wherein a control mechanism of the motor vehicle is adapted to control the power supply of the at least one catalyst, wherein the control mechanism is adapted to carry out the above-described method. All of the features and advantages of the methods describes herein may be applied to the motor vehicles describes herein, which are in particular hybrid vehicles, and vice versa.

The motor vehicle comprises an exhaust gas tract, in which further components are arranged besides the at least one EHC, such as additional catalysts like oxidation and/or SCR catalysts, as well as particulate filters and/or the like. In particular, the motor vehicle may comprise an exhaust gas tract having multiple exhaust gas channels, and an EHC is situated in each of at least two of the multiple exhaust gas channels. In other words, the exhaust gas cleaning here is apportioned over multiple exhaust gas channels or EHCs.

A voltage of $U_1$=48 V can be generated by means of the first battery and/or a voltage of $U_2$=12 V by means of the second battery. Thus, typically the first battery and the second battery are each associated with an onboard network of the motor vehicle, which may comprise further consumers such as controllers, sensors, display elements, and the like.

For the charging of the first battery and/or the second battery, a generator of the motor vehicle may be provided. Especially in the case when the motor vehicle is a hybrid vehicle, the internal combustion engine may function as a corresponding generator.

BRIEF DESCRIPTION OF THE SEVERAL VIEWS OF THE DRAWINGS

Further details and benefits emerge from the following schematic drawings as well as the described embodiments.

DETAILED DESCRIPTION

Figure 1:
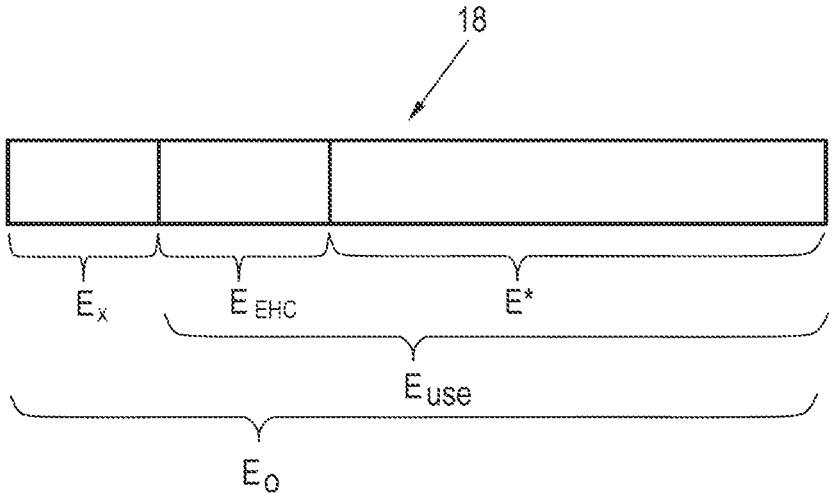
FIG. 1 shows an energy balance diagram of a first battery of a motor vehicle.
Figure 2:
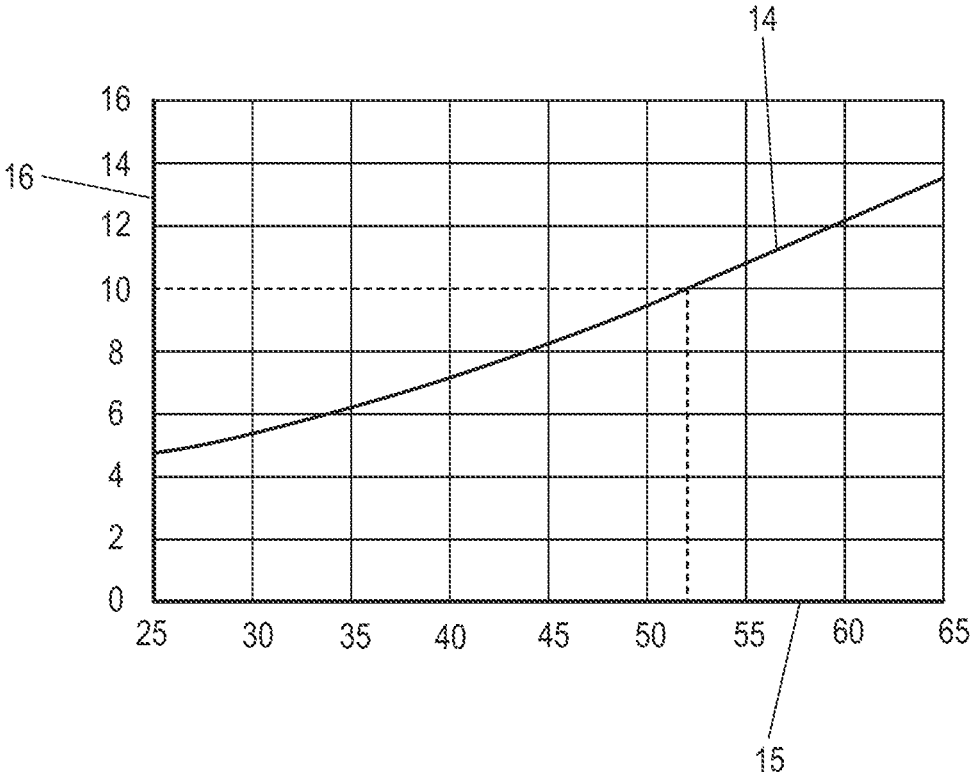
FIG. 2 shows a characteristic curve of a first battery of a motor vehicle.
Figure 3:
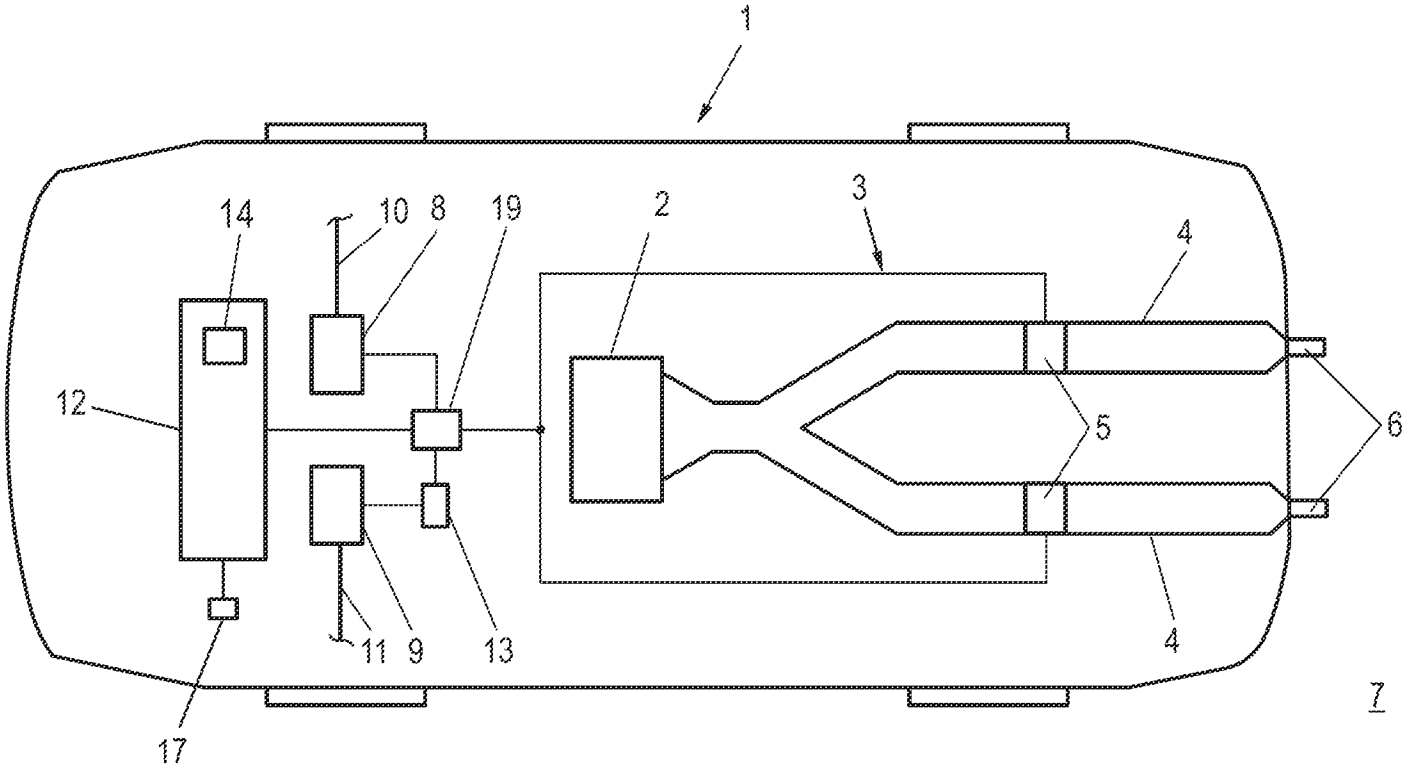
FIG. 3 shows a motor vehicle.

While FIGS. 1 and 2, which will also be taken up later on, show the energy balance diagram 18 and the characteristic curve 14 already described in the introduction, FIG. 3 presents a schematic view of a motor vehicle 1, with the aid of which corresponding embodiments of the method will be explained.

The motor vehicle 1 comprises an internal combustion engine 2 and an exhaust gas tract 3 connected to the internal combustion engine 2. The internal combustion engine 2 is a gasoline engine, for example. The exhaust gases produced by the internal combustion engine 2 are channeled into the exhaust gas tract 3, which comprises two exhaust gas channels 4, for example. In the region of the exhaust gas channels 4 there is arranged a respective electrically heatable catalyst 5 (EHC) as well as other components for the cleaning of the exhaust gas, such as further catalysts like oxidation and/or SCR catalysts, as well as particulate filers and/or the like, not otherwise represented. After passing through the exhaust gas tract 3, the exhaust gas goes across mufflers 6 into the surroundings 7 of the motor vehicle 1.

For the power supply of the EHCs 5 there is a first battery 8, by means of which a first voltage $U_1$ is generated, and a second battery 9, by means of which a second voltage $U_2$ is generated. The first battery 8 serves furthermore for the power supply of a first onboard network 10 and the second battery 9 for the power supply of a second onboard network 11. For example, a voltage of $U_1$=48 V can be generated by means of the first battery 8 and a voltage of $U_2$=12 V by means of the second battery 9.

A control mechanism 12 of the motor vehicle 1 is adapted to control the power supply of the EHC 5 by means of the first battery 8 and the second battery 9. Thus, the first battery 8, the second battery 9 and the EHCs are directly connected by means of an electrical circuit 19 such that they can be interconnected with each other by two possible circuit conditions, wherein the control mechanism 12 is adapted to send corresponding control commands to set the current circuit condition. The electrical circuit 19 is realized by means of components based on semiconductor technology, such as transistors or the like, which are actuated on the part of the control mechanism 12 by appropriate control signals. Details regarding circuits such as the circuit 19 are sufficiently known to the person skilled in the art and therefore will not be further explained.

In a first circuit condition, the EHCs 5 are only energized by the first battery 8. In a second circuit condition, the EHCs 5 are additionally energized by the second battery 9. In the second circuit condition, the system composed of the first battery 8, the second battery 9 and the DC converter 13 works such that two parallel-switched voltage sources of identical voltage $U_1$ are present on the EHCs 5, for their part switched in parallel, one of these voltage sources being the first battery 8 and the second of these voltage sources being formed so to speak by the second battery 9 and the DC converter 13. A switching between the first and the second circuit condition thus has the effect, in terms of the power supply of the EHCs 5, that either only the first battery 8 or the first battery 8 together with the second battery 9 is used, and in both circuit conditions the voltage $U_1$ is present on each of the two EHCs.

The method involves a start phase occurring immediately after the start of the internal combustion engine 2 and lasting for around 30 seconds. During this phase, the requirements for the EHCs 5 are particularly high. This is because the rate of production of pollutants of the internal combustion engine 2 is especially high during the start phase, as compared to other operating phases. During the start phase, the EHCs 5 are supplied on the one hand with a power $P_1$ provided by the first battery 8. On the other hand, the voltage $U_2$ of the second battery 9 is transformed during the start phase by means of a DC converter 13 to the value of the voltage $U_1$ of the first battery 8, the EHCs 5 being additionally supplied by means of the power $P_2$ provided by the second battery 9. In this case, the control mechanism 12 ensures that the EHCs are supplied with an adequate power during the entire start phase, for example with at least their known operating powers $P_{EHC}$.

In the motor vehicle shown in FIG. 3, the voltage $U_1$ provided by means of the first battery 8 and the voltage $U_2$ provided by the second battery 9 and transformed by means of the DC converter 13 to the value $U_1$ are imposed directly on the two EHCs 5. Likewise, however, it may be provided that the voltage provided by the second battery 9 and transformed by means of the DC converter 13 is imposed on the first battery 8 and charges it. There is so to speak an indirect power supply of the EHCs 5 by means of the second battery 9, namely, across the first battery 8.

In the embodiments which are explained with the aid of the figures, the specific aspects mentioned in the introduction and only to be understood as examples will be explicitly assumed, as long as they are not inconsistent with the present descriptions. Thus, it is provided that the first battery 8 is a 48V battery with an overall capacity $E_{ges}$ of 850 Wh and the two EHCs 5 each have a maximum operating power of 5 kW, so that the overall power required by the EHCs 5 is at most $E_{EHC}$=10 kW.

In the following, refer once again to FIG. 2. As already explained, this characteristic curve 14 pertains to the first battery 8, the abscissa 15 or x-axis referring to the state of charge SoC of the first battery 8 in percent and the ordinate 16 or y-axis referring to the power $P_1$ in kW which can be provided by the first battery 8. It is seen from the characteristic curve 14 that a power $P_1$ can only be provided by means of the first battery 8 in a certain region of its state of charge SoC, this region being bounded for example by a lower value of $SoC_0$=25% and an upper value of $SoC_1$=80%. Furthermore, the characteristic curve 14 shows that the power $P_1$ which can be provided by the first battery 8 is dependent on the current state of charge SoC of the first battery 8. The power $P_1$ which can be provided by means of the first battery 8 depends furthermore on the current temperature, the characteristic curve 14 represented in FIG. 2 being plotted at a temperature of −10° C. Thus, multiple characteristic curves 14 or corresponding numerical values each pertaining to a temperature value are saved in the control mechanism 12, especially in the context of a lookup table or an analytical model. The control mechanism 12 is adapted to select the particular characteristic curve 14 in dependence on a metered value of a temperature sensor 17 describing the current temperature. The temperature sensor 17 meters either the current temperature in the surroundings 7 of the motor vehicle 1 or the immediate temperature of the first battery 8.

Thus, it shall first be assumed in one embodiment of the method that the state of charge of the first battery 8 does not fall below the value of $SoC_0$=25% during the entire start phase and that this value should be present at the end of the start phase. It follows from the characteristic curve 14 presented in FIG. 2 that the power $P_1$ which can be provided by the first battery 8 at the end of the start phase, which SoC is supposed to be $SoC_0$=25%, corresponds to around 5 kW. Assuming that the power required by the EHCs at this time is $P_{EHC}$=10 kW, there necessarily results a corresponding power demand on the part of the second battery 9 of $P_2$=5 kW. Due to the circumstance that the first battery 8 can provide a power $P_1$ only at a state of charge of SoC≥25%, it further emerges that the EHCs 5 also need to be supplied at the end of the start phase in addition by means of the power $P_2$ provided by the second battery 9.

If, according to one embodiment of the method, it is provided that the EHCs 5 are only supplied in addition by means of the power $P_2$ provided by the second battery 9 during the start phase or, in other words, no further energy transport should occur from the second battery 9 to the EHCs 5 immediately after the ending of the start phase, then it must be ensured that the first battery 8 can also provide sufficient power $P_1$ for the two EHCs 5 after the ending of the start phase. It is shown by means of the dotted lines in FIG. 2 that, upon ending of the start phase, a state of charge SoC of the first battery of at least around 50% must be present, as long as it is assumed that the power required by the two EHCs at this time is $P_{EHC}$=10 kW. In addition, or alternatively, the internal combustion engine 2 may drive an electric machine of the motor vehicle 1, not shown, in order to provide an additional power after the end of the start phase.

In one embodiment of the method, the energy supply of the EHCs during the start phase is apportioned between the first battery 8 and the second battery 9 according to a firmly set provision quotient amount to a value of 2. The provision quotient is defined as the ratio of the energy $E_1$ provided by the first battery 8 during the start phase and the overall energy $E_{EHC}$ required by the EHCs 5 during the start phase. Since the energy required by the EHCs amounts to $E_{EHC}$=85 Wh, each of the batteries 8, 9 therefore provides 42.5 Wh. Given an overall storage capacity of the first battery 8 of $E_0$=850 Wh, therefore 5% of the maximum cumulative energy of the first battery 8 is required. Since, during the start phase, the state of charge of the first battery 8 should not fall below the value of 25%, the first battery 8 at the beginning of the start phase must have a state of charge of 30%. Thus, the above calculated value of $SoC_{crit}$=50% can basically be reduced to a value of as much as $SoC_{crit}$=30%, as long as the second battery 9 and especially the DC converter 13 and the onboard network stability of the second onboard network 11 allow for providing a power of $P_2$=5 kW for the EHCs 5 by the second battery 9 during the start phase.

In one embodiment of the method, the power which can be provided by the second battery 9 is bounded at the top, namely, at $P_2^{max}$=2-3 kW, for example due to the stability of the second onboard network 11 not being otherwise assured, in which case a specific value of $P_2^{max}$=3 kW is assumed. In order to allow for this circumstance, it is advisable to apportion the power or energy supply of the EHCs 5 between the batteries 8, 9 during the start phase by a provision quotient of Q=0.3, as long as the EHCs have a constant power demand during the entire start phase. In this regard, it may be further provided that the provision quotient Q is additionally set with the help of a state of charge information describing the state of charge SoC of the batteries 8, 9, which is either ascertained by sensor and/or is present any way in the context of a controlling of the motor vehicle 1 by means of a control unit, which may be the control mechanism 12, for example.

Thus, if the first battery 8 during the start phase should not fall below the state of charge SoC of 30% and if the power which can be provided by the second battery 9 is limited to $P_2^{max}$=3 kW, the EHCs 5 must continue to be supplied by the second battery 9 after the end of the start phase. Thus, as is also evident from the characteristic curve of FIG. 2, it is no longer possible to assure the overall power required by the EHCs of $P_{EHC}$=10 kW solely by means of the first battery 8 at a state of charge of SoC=30%. The corresponding limitation of the power $P_2$ is also particularly advantageous because in this way no further components need to be provided, which would increase the performance or onboard network stability of the second onboard network 11.

Assuming that the power required by the EHCs 5 during the entire start phase is constant at $P_{EHC}$=10 kW and that the second battery provides a maximum of $P_2$=3 kW, the first battery must therefore deliver a power of $P_1$=7 kW. From the characteristic curve 14 presented in FIG. 2 it follows that the state of charge of the first battery 8 should not fall below the value of SoC≈37%, i.e., 7% more than the above calculated value of $SoC_{crit}$, corresponding to an energy quantum of around 60 Wh. Consequently, the second battery 9 must provide an energy of 25 Wh, in view of the overall energy of $E_{EHC}$=85 Wh, which is the case at $P_2$=3 Wh and a start phase duration of 30 seconds. As long as $P_2^{max}$ takes on a value of up to 5 kW, the second battery 9 can still provide an energy during the start process of up to around 42 Wh.

Speaking in general, this means that the power or energy supply of the EHCs 5 during the start phase is apportioned according to the adjustable provision quotient Q between the first battery 8 and the second battery 9. For sake of completeness, it should be mentioned in this place that the power or energy supply of the EHCs 5 can be apportioned even after the ending of the start phase according to a fixed provision quotient Q between the batteries 8, 9. It becomes clear from the concrete example just presented that the usable energy $E_{use}$ available on the part of the first battery 8 can be significantly increased, and in particular the so-called P/E ratio of the batteries involved, i.e., the ratio of power to energy, describing the power uptake characteristic, can be optimally utilized.

German patent application no. 10 2021 103481.7, filed Feb. 15, 2021, to which this application claims priority, is hereby incorporated herein by reference, in its entirety.

Aspects of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A method for providing a power supply for at least one electrically heatable catalyst situated in an exhaust gas tract of a motor vehicle, comprising:

generating a first voltage U1 using a first battery of the motor vehicle;

generating a second voltage U2 using a second battery of the motor vehicle;

during a start phase immediately following a start of an internal combustion engine of the motor vehicle, supplying the at least one electrically heatable catalyst with a first power P1 provided by the first battery such that the voltage U1 of the first battery is imposed on the at least one electrically heatable catalyst; and during the start phase, supplying the at least one electrically heatable catalyst with a second power P2 provided by the second battery such that the voltage U2 of the second battery is transformed by a DC converter to the voltage U1 which is imposed on the at least one electrically heatable catalyst;

wherein the first battery only provides the power P1 in a particular region of its state of charge SoC, and this region is bounded by a lower value SoC0 and an upper value SoC1, wherein the lower value SoC0 is 25% and the upper value SoC1 is 80% of a maximum state of charge of the first battery, and energy EEHC consumed during the start phase of the at least one electrically heatable catalyst is apportioned between the first battery and the second battery such that, upon ending of the start phase, the state of charge SoC of the first battery corresponds at least to the lower value SoC0.

2. The method according to claim 1, wherein the at least one electrically heatable catalyst is supplied in addition by the power P2 provided by the second battery during the start phase only.

3. The method according to claim 1, wherein the at least one electrically heatable catalyst is also supplied by the power P2 provided by the second battery after the ending of the start phase.

4. A method for providing a power supply for at least one electrically heatable catalyst situated in an exhaust gas tract of a motor vehicle, comprising:

generating a first voltage U1 using a first battery of the motor vehicle;

generating a second voltage U2 using a second battery of the motor vehicle;

during a start phase immediately following a start of an internal combustion engine of the motor vehicle, supplying the at least one electrically heatable catalyst with a first power P1 provided by the first battery such that the voltage U1 of the first battery is imposed on the at least one electrically heatable catalyst; and during the start phase, supplying the at least one electrically heatable catalyst with a second power P2 provided by the second battery such that the voltage U2 of the second battery is transformed by a DC converter to the voltage U1 which is imposed on the at least one electrically heatable catalyst;

wherein the power P1 which can be provided by the first battery depends on its current state of charge SoC, while the energy EEHC consumed during the start phase by the at least one electrically heatable catalyst is apportioned between the first battery and the second battery such that, upon ending of the start phase, the power P1 which can be provided by the first battery corresponds at least to the power of the at least one electrically heatable catalyst which is required at this time.

5. The method according to claim 4, wherein a known characteristic curve and/or a lookup table and/or a model, is used to apportion the energy EEHC consumed during the start phase by the at least one electrically heatable catalyst between the first battery and the second battery, which describes the region of the state of charge SoC of the first battery in which it provides the power P1, and/or the dependency of the power P1 which can be provided by the first battery on its state of charge SoC, in temperature-dependent manner.

6. A method for providing a power supply for at least one electrically heatable catalyst situated in an exhaust gas tract of a motor vehicle, comprising:

generating a first voltage U1 using a first battery of the motor vehicle;

generating a second voltage U2 using a second battery of the motor vehicle;

during a start phase immediately following a start of an internal combustion engine of the motor vehicle, supplying the at least one electrically heatable catalyst with a first power P1 provided by the first battery such that the voltage U1 of the first battery is imposed on the at least one electrically heatable catalyst; and during the start phase, supplying the at least one electrically heatable catalyst with a second power P2 provided by the second battery such that the voltage U2 of the second battery is transformed by a DC converter to the voltage U1 which is imposed on the at least one electrically heatable catalyst;

wherein the energy EEHC transferred during the start phase and/or after the end of the start phase from the first battery and the second battery to the at least one electrically heatable catalyst is apportioned by a fixed or adjustable provision quotient Q between the first battery and the second battery;

wherein the provision quotient is set with the help of at least one state of charge information item describing the state of charge SoC of the first battery and/or the state of charge SoC of the second battery, wherein the state of charge information is ascertained by at least one sensor of the motor vehicle and/or is present in the context of a controlling of the motor vehicle which can be done by a control unit.

* * * * *